US010153573B1

(12) United States Patent
Chen

(10) Patent No.: US 10,153,573 B1
(45) Date of Patent: Dec. 11, 2018

(54) MULTI-PURPOSE FEMALE METAL TERMINAL AND FEMALE TERMINAL CONNECTOR

(71) Applicant: Xiamen GHGM Industrial Trade Co., Ltd., Xiamen (CN)

(72) Inventor: Bingshui Chen, Xiamen (CN)

(73) Assignee: XIAMEN GHGM INDUSTRIAL TRADE CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/807,545

(22) Filed: Nov. 8, 2017

(51) Int. Cl.

| | |
|---|---|
| ***H01R 12/71*** | (2011.01) |
| ***H01R 13/11*** | (2006.01) |
| ***H01R 13/20*** | (2006.01) |
| ***H01R 12/73*** | (2011.01) |
| ***H01R 13/514*** | (2006.01) |

(52) U.S. Cl.
CPC ..... *H01R 13/113* (2013.01); *H01R 12/716* (2013.01); *H01R 12/732* (2013.01); *H01R 13/20* (2013.01); *H01R 13/514* (2013.01)

(58) Field of Classification Search
CPC ..... H01R 23/7063; H01R 13/4223; H01R 13/514; H01R 13/2457; H01R 13/20; H01R 12/585; H01R 12/592
See application file for complete search history.

(56) References Cited

U.S. PATENT DOCUMENTS

| | | | | |
|---|---|---|---|---|
| 3,865,462 | A * | 2/1975 | Cobaugh | H01R 13/428 439/682 |
| 5,078,611 | A * | 1/1992 | Tanigawa | H01R 12/515 439/78 |
| 5,688,143 | A * | 11/1997 | McHugh | H01R 12/79 439/495 |
| 6,056,603 | A * | 5/2000 | Pauza | H01R 13/41 439/733.1 |
| 6,287,130 | B1 * | 9/2001 | Torii | H01R 12/707 439/83 |
| 6,302,711 | B1 * | 10/2001 | Ito | H01R 4/028 439/733.1 |
| 2004/0023546 | A1 * | 2/2004 | Wu | H01R 13/6275 439/352 |
| 2006/0141859 | A1 * | 6/2006 | Sakamoto | H05K 3/301 439/570 |
| 2015/0207269 | A1 * | 7/2015 | Sha | H01R 12/707 439/83 |

* cited by examiner

*Primary Examiner* — Briggitte R Hammond
(74) *Attorney, Agent, or Firm* — Muncy, Geissler, Olds & Lowe, P.C.

(57) ABSTRACT

A multi-purpose female metal terminal has a substrate. A front end of the substrate is formed with an elastic sheet. The elastic sheet is bent to form a curved segment for a male terminal to be selectively horizontally overlapped with the multi-purpose female metal terminal. A middle of the elastic sheet is formed with a gap for the male terminal to be selectively vertically interconnected with the multi-purpose female metal terminal. A female terminal connector is provided. The multi-purpose female metal terminal has a simple structure, and can be transversely or vertically connected with the male terminal, and has strong adaptability.

2 Claims, 15 Drawing Sheets

MULTI-PURPOSE FEMALE METAL TERMINAL AND FEMALE TERMINAL CONNECTOR

BACKGROUND OF THE INVENTION

1. Field of the Invention

The present invention relates to an electrical connector, and more particularly to a multi-purpose female metal terminal which can be transversely overlapped with and vertically interconnected with a male terminal, and a female terminal connector using the female metal terminal.

2. Description of the Prior Art

In the prior art, the electrical connection between a male terminal and a female terminal may adopt a wire or a connector. The former is troublesome, and its connection is not strong. The latter is convenient. However, for the connector, there is only one relative position between the male terminal and the female terminal, and the adaptability of the product is poor.

SUMMARY OF THE INVENTION

The primary object of the present invention is to provide a multi-purpose female metal terminal, which has a simple structure and can be transversely overlapped with or vertically interconnected with a male terminal and has strong adaptability.

The present invention also provides a female terminal connector using the multi-purpose female metal terminal.

According to one aspect of the present invention, a multi-purpose female metal terminal is provided. The multi-purpose female metal terminal has a substrate. A front end of the substrate is formed with an elastic sheet. The elastic sheet is bent to form a curved segment for a male terminal to be selectively horizontally overlapped with the multi-purpose female metal terminal. A middle of the elastic sheet is formed with a gap for the male terminal to be selectively vertically interconnected with the multi-purpose female metal terminal.

According to another aspect of the present invention, a female terminal connector is provided. The female terminal connector comprises the aforesaid multi-purpose female metal terminal and a plastic core. The multi-purpose female metal terminal has a substrate. A front end of the substrate is formed with an elastic sheet. The elastic sheet is bent to form a curved segment. The curved segment is configured to horizontally overlap a male terminal. A gap is formed in a middle of the elastic sheet. The gap is configured to receive the male terminal vertically inserted in the gap. A rear end of the substrate is formed with a turning elastic tab. The plastic core has an accommodation cavity for the multi-purpose female metal terminal to be fixed therein. The elastic sheet of the multi-purpose female metal terminal is located at a front section of the accommodation cavity. The substrate and the turning elastic tab at the rear end of the substrate are located at a rear section of the accommodation cavity. A front end of the plastic core is formed with a male terminal insertion opening in communication with the accommodation cavity. A rear end of the plastic core is formed with a conductive wire insertion opening in communication with the accommodation cavity.

According to a further aspect of the present invention, a female terminal connector is provided. The female terminal connector comprises a multi-purpose female metal terminal and a plastic core. The multi-purpose female metal terminal has a substrate. A front end of the substrate is formed with an elastic sheet. The elastic sheet is bent to form a curved segment. The curved segment is configured to horizontally overlap a male terminal. A gap is formed in a middle of the elastic sheet. The gap is configured to receive the male terminal vertically inserted in the gap. A rear end of the substrate is formed with a pin. The plastic core has an accommodation cavity for the multi-purpose female metal terminal to be fixed therein. The elastic sheet of the multi-purpose female metal terminal is located at a front section of the accommodation cavity. The substrate is located at a rear section of the accommodation cavity. A front end of the plastic core is formed with a male terminal insertion opening in communication with the accommodation cavity. A rear end of the plastic core is formed with a through hole in communication with the accommodation cavity. The pin at the rear end of the substrate is located outside the through hole. A fixing piece is mounted to a side of the plastic core. The plastic core is fixed on a printed circuit board through the pin and the fixing piece.

Preferably, the rear end of the substrate has an L-shaped bend to form the pin. The pin is located outside the through hole and attached to the rear end of the plastic core to extend toward one side. A first side of the plastic core is formed with a slot. The fixing piece has an L shape. The fixing piece has a vertical side inserted in the slot. An upper end of the vertical side is formed with a stop block to be retained on the slot so that the fixing piece is positioned. The fixing piece has a transverse side attached to the rear end of the plastic core to extend toward another side. The rear end of the plastic core is directly erected and fixed on the printed circuit board through the pin and the fixing piece.

Alternatively, the rear end of the substrate has a ⊏-shaped bend. A distal end of the substrate has an L-shaped bend to form the pin. The ⊏-shaped bend at the rear end of the substrate covers the rear end of the plastic core. The L-shaped pin is located at a center of a third side of the plastic core and extends outward. A first side of the plastic core is formed with a slot. The fixing piece has an L shape. The fixing piece has a vertical side inserted in the slot. An upper end of the vertical side is formed with a stop block to be retained on the slot so that the fixing piece is positioned. The fixing piece has a transverse side located at a center of the first side of the plastic core and extends outward. The rear end of the plastic core is sunk in a hole of the printed circuit board and erected and fixed on the printed circuit board.

Alternatively, the rear end of the substrate has a Z-shaped bend to form the pin. A middle section of the Z-shaped bend is attached to the rear end of the plastic core. The pin at a distal section of the Z-shaped bend is attached to a third side of the plastic core and extends toward a back of the plastic core. Each of a second side and an adjacent fourth side of the plastic core is formed with a slot. The fixing piece has an L shape. The fixing piece has a vertical side inserted in the slot. An upper end of the vertical side is formed with a stop block to be retained on the slot so that the fixing piece is positioned. The fixing piece has a transverse side attached to the third side of the plastic core to extend outward. The third side of the plastic core is fixed to the printed circuit board by SMT (surface mount technology) in cooperation with the pin and the fixing piece.

The female metal terminal of the present invention has a simple structure, and the structure of the entire connector is simple and easy to mount and fix. According to the present invention, since the elastic sheet is bent to form the curved segment to transversely overlap the male terminal. The middle of the elastic sheet is formed with the gap for the male terminal to be vertically inserted in the gap. The female metal terminal of the present invention can be transversely or vertically connected with the male terminal, having strong adaptability.

DETAILED DESCRIPTION OF THE PREFERRED EMBODIMENTS

Embodiments of the present invention will now be described, by way of example only, with reference to the accompanying drawings.

Figure 4:
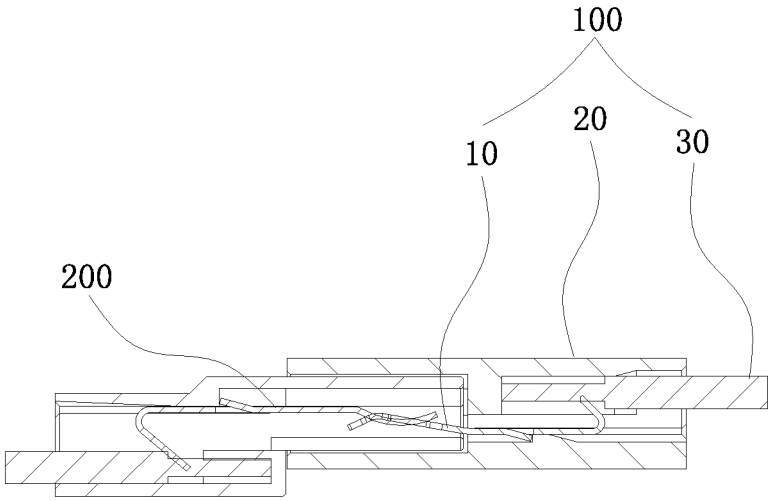
FIG. 4 is a schematic view of the connector using the metal terminal of FIG. 1*a* horizontally overlapped with the female terminal.
Figure 5:
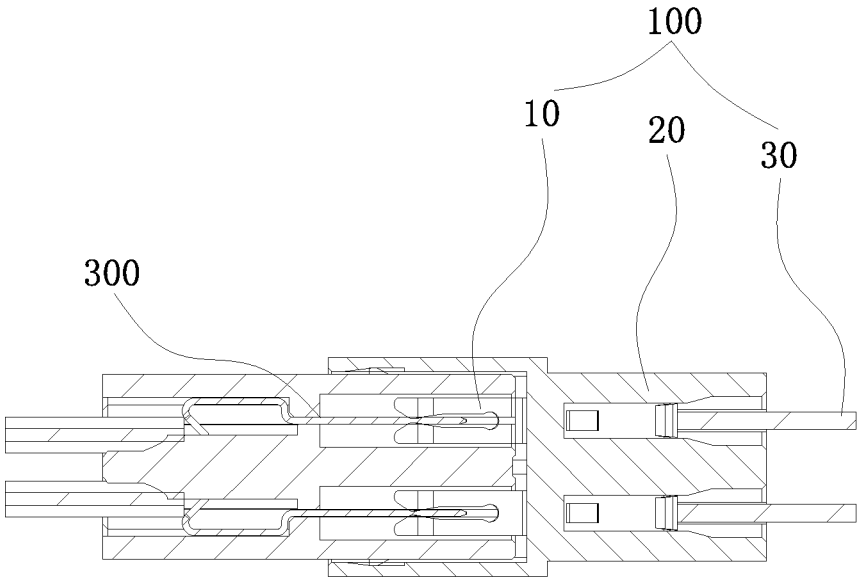
FIG. 5 is a schematic view of the connector using the metal terminal of FIG. 1*a* vertically interconnected with the female terminal.

As shown in FIG. 1*a* to FIG. 1*d*, a multi-purpose female metal terminal 10 of the present invention has a substrate 11. A front end of the substrate 11 is formed with an elastic sheet 12. The elastic sheet 12 is bent to form a curved segment 13 for a male terminal 200 (as shown in FIG. 4) to be selectively horizontally overlapped with the multi-purpose female metal terminal. A middle of the elastic sheet 12 is formed with a gap 14 for a male terminal 300 to be selectively vertically interconnected with the multi-purpose female metal terminal (as shown in FIG. 5). In this way, a female terminal may be connected with a male terminal horizontally or vertically, having strong adaptability.

Figure 1A:
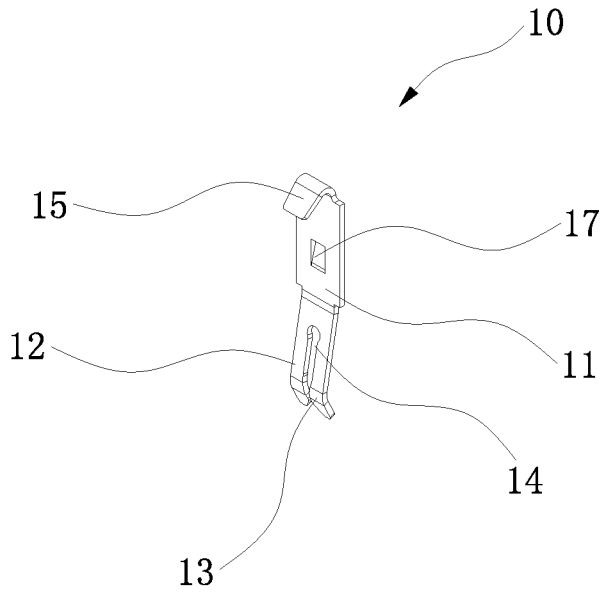
FIGS. 1*a*-1*d* are perspective views of the metal terminal according to four embodiments of the present invention.
Figure 1B:
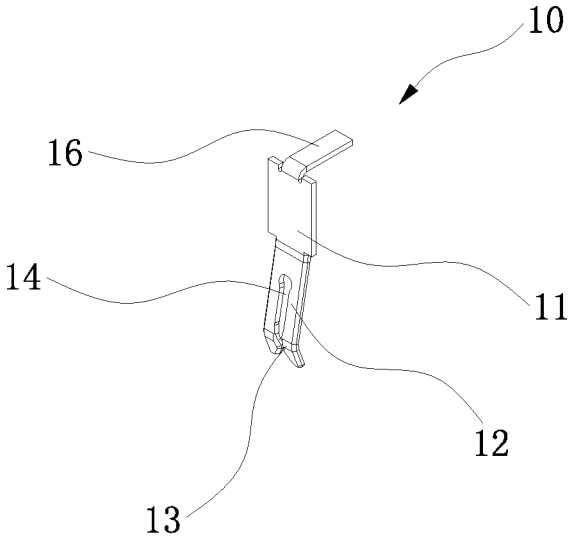
Figure 1C:
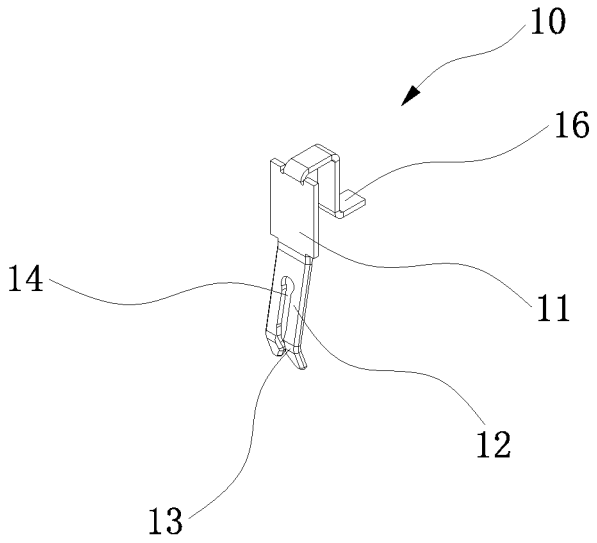
Figure 1D:
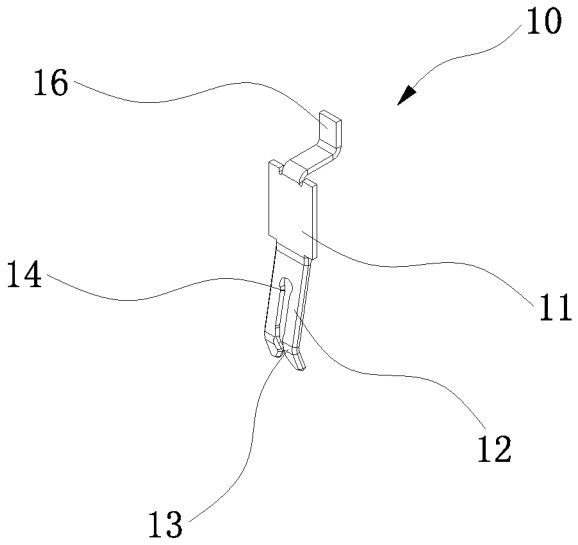

For the female metal terminal to adapt different connections, as shown in FIG. 1*a*, a rear end of the substrate 11 is formed with a turning elastic tab 15 for connection of a conductive wire 40. As shown in FIG. 1*b* to FIG. 1*d*, the rear end of the substrate 11 is formed with a pin 16 for connection of a PCB (printed circuit board). The specific embodiments are described below to mate with a fixing piece 30 in different mounting ways.

As shown in FIG. 2 to FIG. 14, a female terminal connector 100 of the present invention includes the aforesaid multi-purpose female metal terminal 10 and a plastic core 20.

Figure 2:
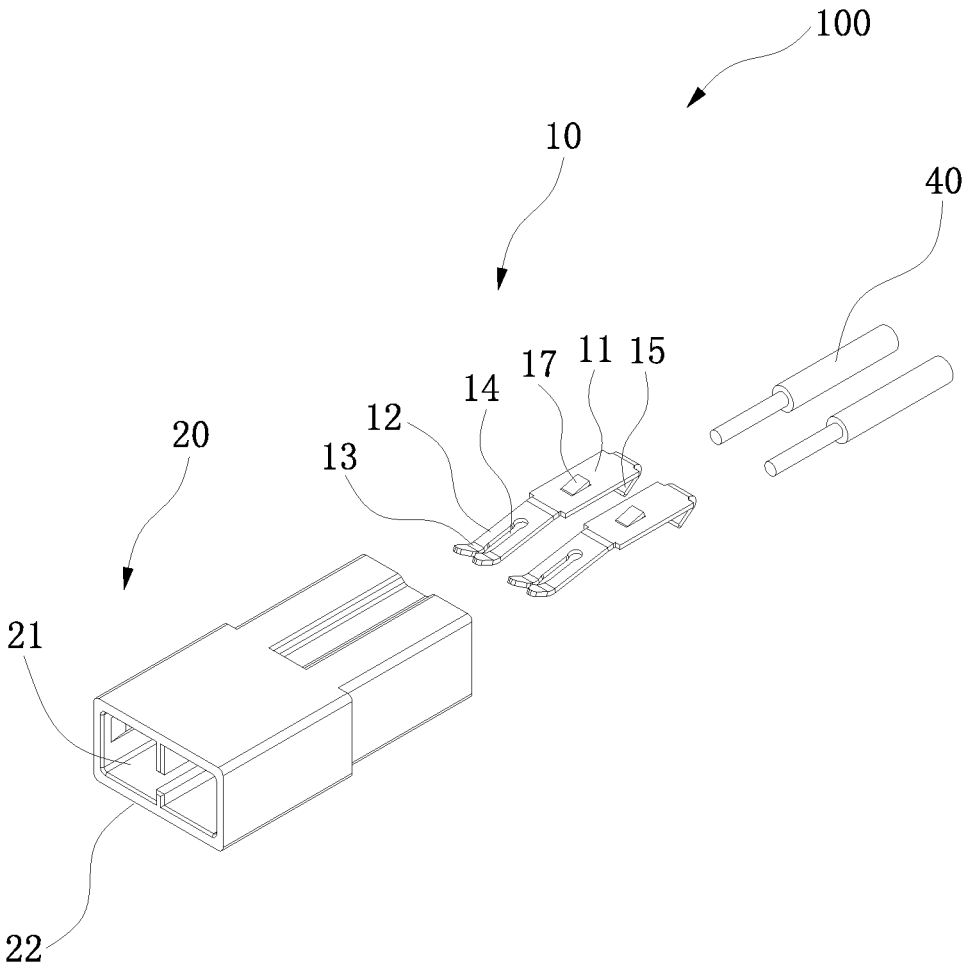
FIG. 2 is an exploded view of the connector using the metal terminal of FIG. 1*a;*
Figure 3:
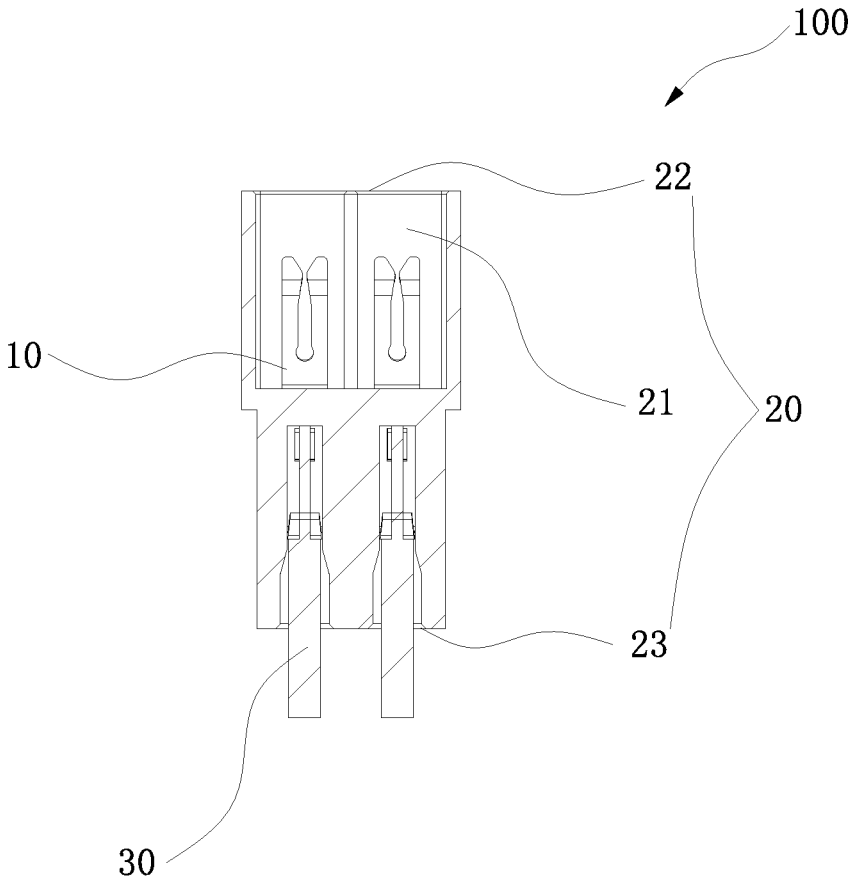
FIG. 3 is a sectional view of the connector using the metal terminal of FIG. 1*a;*

For the multi-purpose female metal terminal 10 illustrated in FIG. 1*a*, as shown in FIG. 2 and FIG. 3, the plastic core 20 has an accommodation cavity 21 for the multi-purpose female metal terminal 10 to be fixed therein. The elastic sheet 12 of the multi-purpose female metal terminal 10 is located at a front section of the accommodation cavity 21. The substrate 10 and the turning elastic tab 15 at the rear end of the substrate 11 are located at a rear section of the accommodation cavity 21. A front end of the plastic core 20 is formed with a male terminal insertion opening 22 in communication with the accommodation cavity 21. A rear end of the plastic core 20 is formed with a conductive wire insertion opening 23 in communication with the accommodation cavity 21.

Figure 14:
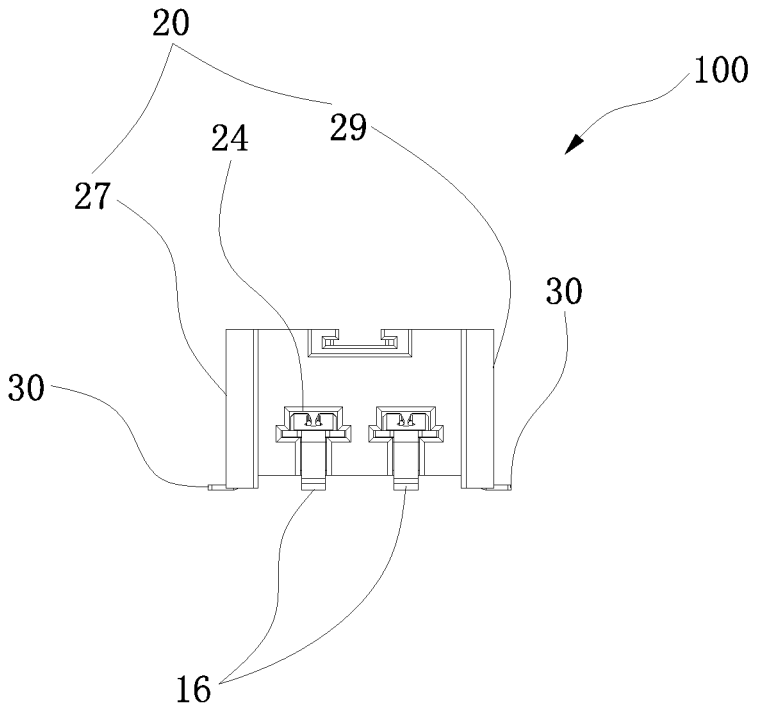
FIG. 14 is a bottom view of the connector using the metal terminal of FIG. 1*d.*

For the multi-purpose female metal terminal 10 illustrated in FIG. 1*b* to FIG. 1*d*, as shown in FIG. 4 and FIG. 14, the plastic core 20 has an accommodation cavity 21 for the multi-purpose female metal terminal 10 to be fixed therein. The elastic sheet 12 of the multi-purpose female metal terminal 10 is located at a front section of the accommodation cavity 21. The substrate 10 is located at a rear section of the accommodation cavity 21. A front end of the plastic core 20 is formed with a male terminal insertion opening 22 in communication with the accommodation cavity 21. A rear end of the plastic core 20 is formed with a through hole 24 in communication with the accommodation cavity 21. The pin 16 at the rear end of the substrate 11 is located outside the through hole 24. A fixing piece 30 is mounted to a side of the plastic core 20. The plastic core 20 is fixed to the PCB through the pin 16 and the fixing piece 30.

Figure 6:
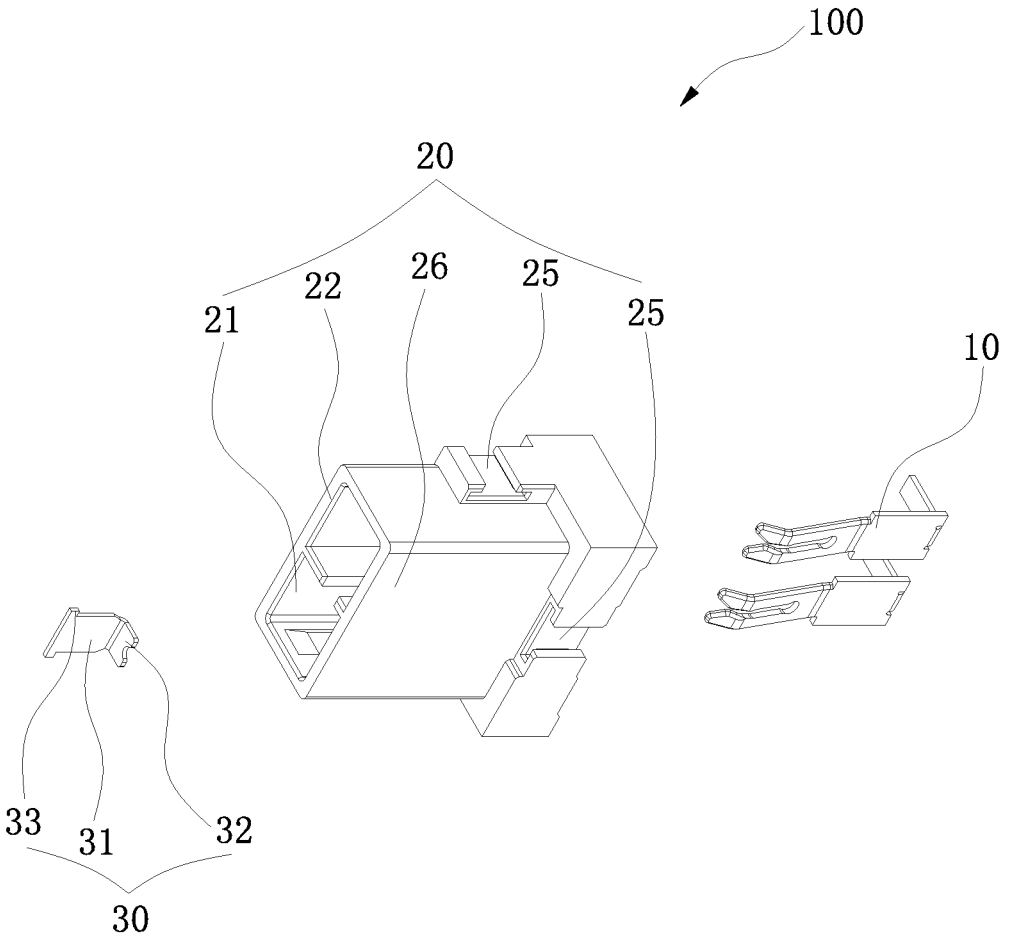
FIG. 6 is an exploded view of the connector using the metal terminal of FIG. 1*b;*
Figure 7:
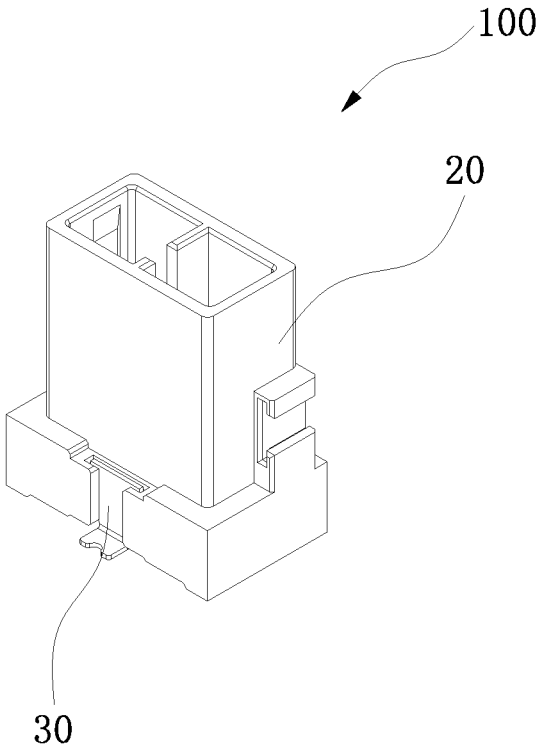
FIG. 7 is a perspective view of the connector using the metal terminal of FIG. 1*b;*
Figure 8:
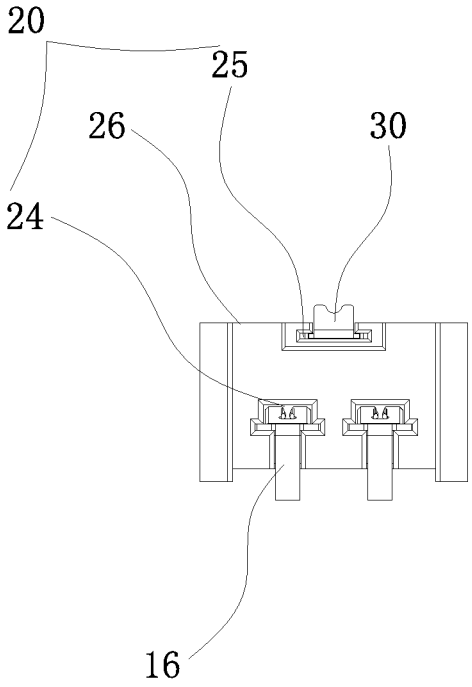
FIG. 8 is a bottom view of the connector using the metal terminal of FIG. 1*b;*

Using the multi-purpose female metal terminal 10 illustrated in FIG. 1*b*, as shown in FIG. 6 to FIG. 8, the rear end of the substrate 11 has an L-shaped bend to form the pin 16 directly. The pin 16 is located outside the through hole 24 and attached to the rear end of the plastic core 20 to extend toward one side thereof. A first side 26 of the plastic core 20 is formed with a slot 25. The fixing piece 30 has an L shape. The fixing piece 30 has a vertical side 31 inserted in the slot 25. An upper end of the vertical side 31 is formed with a stop block 33 to be retained on the slot 25 so that the fixing piece 30 is positioned. The fixing piece 30 has a transverse side 32 attached to the rear end of the plastic core 20 to extend toward another side thereof. The rear end of the plastic core 20 may be directly erected and fixed on the PCB.

Figure 9:
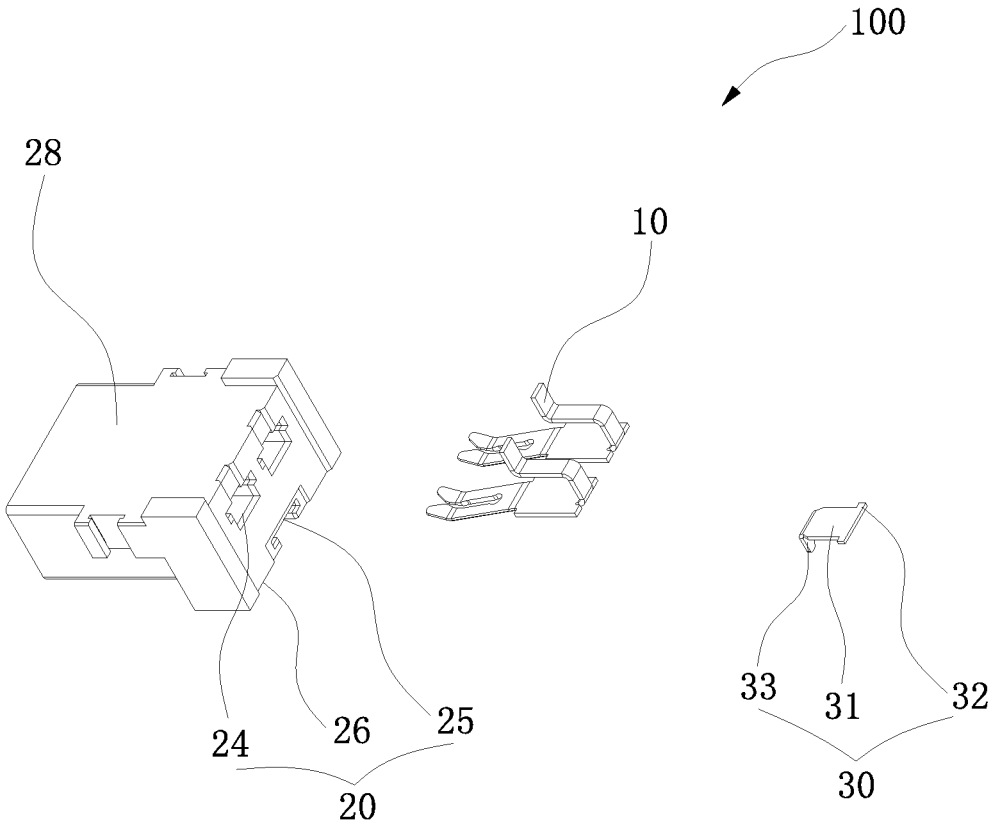
FIG. 9 is an exploded view of the connector using the metal terminal of FIG. 1*c;*
Figure 10:
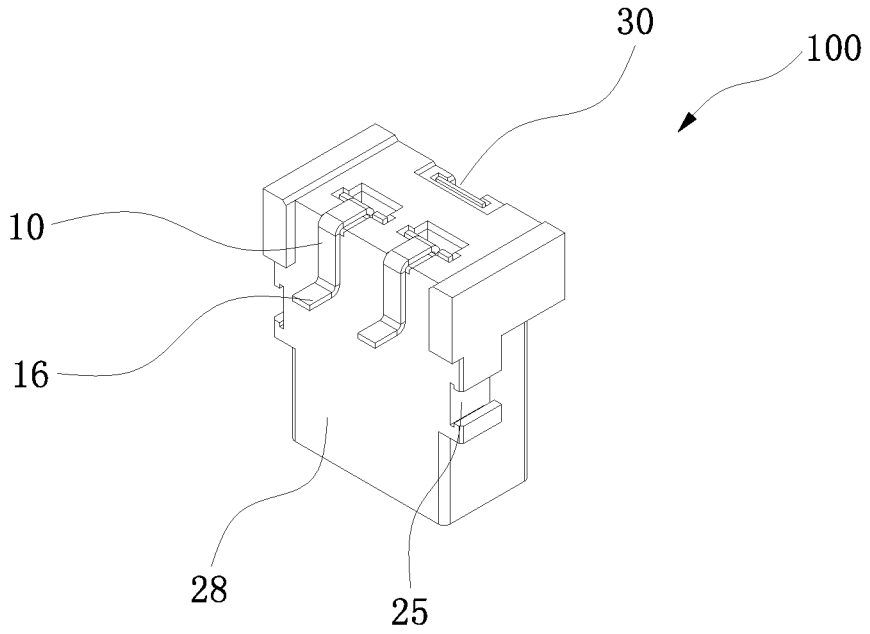
FIG. 10 is a perspective view of the connector using the metal terminal of FIG. 1*c;*
Figure 11:
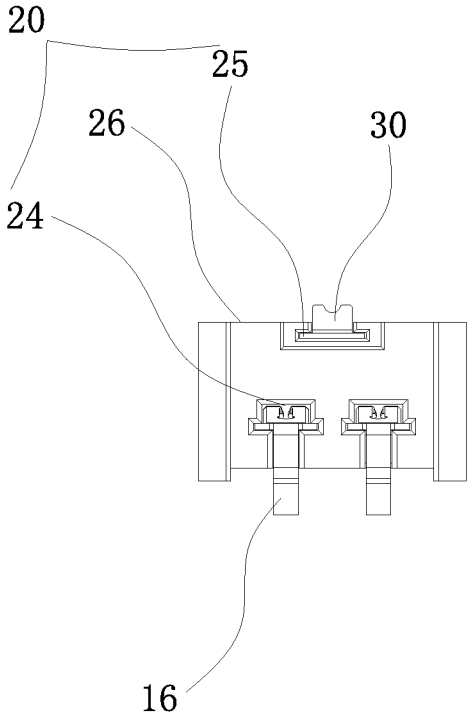
FIG. 11 is a bottom view of the connector using the metal terminal of FIG. 1*c;*

Using the multi-purpose female metal terminal 10 illustrated in FIG. 1*c*, as shown in FIG. 9 to FIG. 11, the rear end of the substrate 11 has a ⊏-shaped bend and the distal end of the substrate 11 has an L-shaped bend to form the pin 16. The ⊏-shaped bend at the rear end of the substrate 11 covers the rear end of the plastic core 20. The L-shaped pin 16 is located at the center of a third side 28 of the plastic core 20 and extends outward. A first side 26 of the plastic core 20 is formed with a slot 25. The fixing piece 30 has an L shape. The fixing piece 30 has a vertical side 31 inserted in the slot 25. An upper end of the vertical side 31 is formed with a stop block 33 to be retained on the slot 25 so that the fixing piece 30 is positioned. The fixing piece 30 has a transverse side 32 located at the center of the first side 26 of the plastic core 20 and extends outward. The rear end of the plastic core 20 may be sunk in a hole of the PCB and erected and fixed on the PCB. In order to secure the multi-purpose female metal terminal 10 better, the substrate 11 is formed with a barb 17. Through the barb 17 to engage with the inner wall of the accommodation cavity 21, and the multi-purpose female metal terminal 10 is firmly secured in the accommodation cavity 21.

Figure 12:
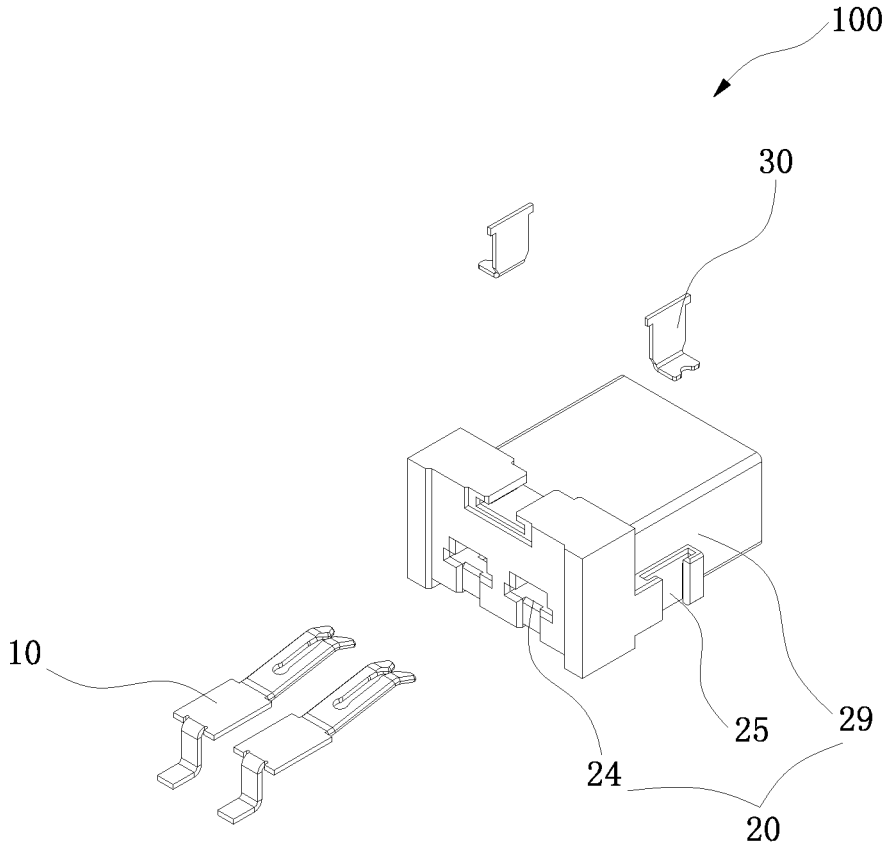
FIG. 12 is an exploded view of the connector using the metal terminal of FIG. 1*d;*
Figure 13:
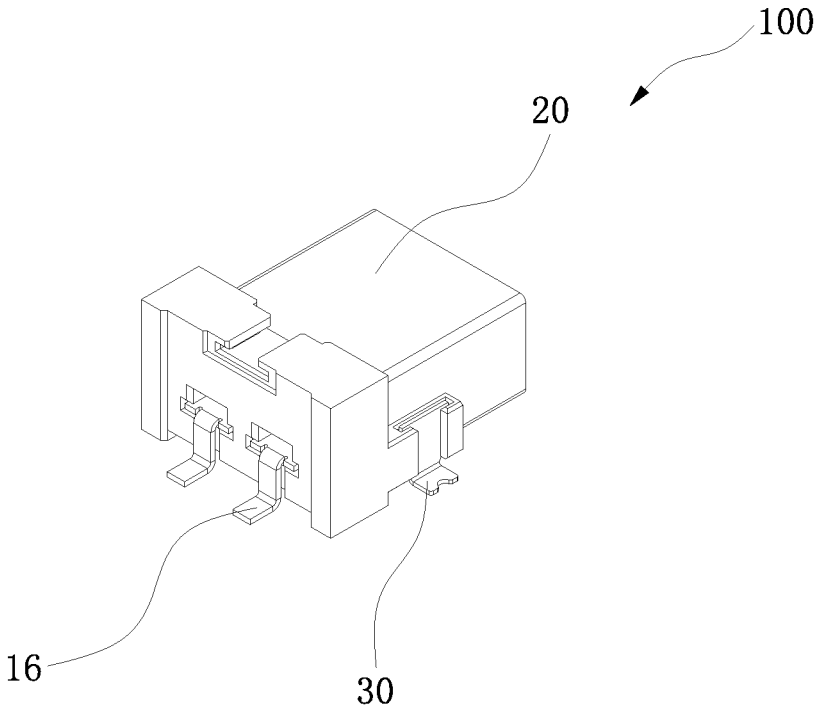
FIG. 13 is a perspective view of the connector using the metal terminal of FIG. 1*d*.

Using the multi-purpose female metal terminal 10 illustrated in FIG. 1*d*, as shown in FIG. 12 to FIG. 14, the rear end of the substrate 11 has a Z-shaped bend to form the pin 16. A middle section of the Z-shaped bend is attached to the rear end of the plastic core 20. The pin 16 at a distal section of the Z-shaped bend is attached to a third side 28 of the plastic core 20 and extends toward the back of the plastic core 20. Each of a second side 27 and an adjacent fourth side 29 of the plastic core 20 is formed with a slot 25. The fixing piece 30 has an L shape. The fixing piece 30 has a vertical side 31 inserted in the slot 25. An upper end of the vertical side 31 is formed with a stop block 33 to be retained on the slot 25 so that the fixing piece 30 is positioned. The fixing piece 30 has a transverse side 32 attached to the third side 28 of the plastic core 20 to extend outward. The third side 28 of the plastic core 20 is fixed on the PCB by SMT (Surface Mount Technology) in cooperation with the pin 16 and the fixing piece 30.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A female terminal connector, comprising a multi-purpose female metal terminal and a plastic core; the multi-purpose female metal terminal having a substrate; a front end of the substrate being formed with an elastic sheet; the elastic sheet being bent to form a curved segment, the curved segment being configured to horizontally overlap a male terminal, a gap being formed in a middle of the elastic sheet, the gap being configured to receive the male terminal vertically inserted in the gap, a rear end of the substrate being formed with a pin; the plastic core having an accommodation cavity for the multi-purpose female metal terminal to be fixed therein, the elastic sheet of the multi-purpose female metal terminal being located at a front section of the accommodation cavity, the substrate being located at a rear section of the accommodation cavity, a front end of the plastic core being formed with a male terminal insertion opening in communication with the accommodation cavity, a rear end of the plastic core being formed with a through hole in communication with the accommodation cavity, the pin at the rear end of the substrate being located outside the through hole, and a fixing piece being mounted to a side of the plastic core;

wherein the rear end of the substrate has a ⊏-shaped bend, a distal end of the substrate has an L-shaped bend to form the pin, the ⊏-shaped bend at the rear end of the 5 substrate covers the rear end of the plastic core, the L-shaped pin is located at a center of a third side of the plastic core and extends outward, a first side of the plastic core is formed with a slot, the fixing piece has an L shape, the fixing piece has a vertical side inserted in the slot, an upper end of the vertical side is formed with a stop block to be retained on the slot so that the fixing piece is positioned, and the fixing piece has a transverse side located at a center of the first side of the plastic core and extends outward.

2. A female terminal connector, comprising a multi-purpose female metal terminal and a plastic core; the multi-purpose female metal terminal having a substrate; a front end of the substrate being formed with an elastic sheet; the elastic sheet being bent to form a curved segment, the curved segment being configured to horizontally overlap a male terminal, a gap being formed in a middle of the elastic sheet, the gap being configured to receive the male terminal vertically inserted in the gap, a rear end of the substrate being formed with a pin; the plastic core having an accommodation cavity for the multi-purpose female metal terminal to be fixed therein, the elastic sheet of the multi-purpose female metal terminal being located at a front section of the accommodation cavity, the substrate being located at a rear section of the accommodation cavity, a front end of the plastic core being formed with a male terminal insertion opening in communication with the accommodation cavity, a rear end of the plastic core being formed with a through hole in communication with the accommodation cavity, the pin at the rear end of the substrate being located outside the through hole, and a fixing piece being mounted to a side of the plastic core;

wherein the rear end of the substrate has a Z-shaped bend to form the pin, a middle section of the Z-shaped bend is attached to the rear end of the plastic core, the pin at a distal section of the Z-shaped bend is attached to a third side of the plastic core and extends toward a back of the plastic core, each of a second side and an adjacent fourth side of the plastic core is formed with a slot, the fixing piece has an L shape, the fixing piece has a vertical side inserted in the slot of the second side or the adjacent forth side of the plastic core, an upper end of the vertical side is formed with a stop block to be retained on the slot so that the fixing piece is positioned, and the fixing piece has a transverse side attached to the third side of the plastic core to extend outward.

* * * * *